US006047458A

United States Patent [19]

Merrill et al.

[11] Patent Number: 6,047,458

[45] Date of Patent: Apr. 11, 2000

[54] ROTATABLE DEWIRING APPARATUS

[75] Inventors: Stanley R. Merrill, Hoquiam, Wash.; Michael E. Hawley, Beaconsfield, Canada; Paul Dalietos, Tumwater, Wash.

[73] Assignee: Lamb-Grays Harbor Co., Hoquiam, Wash.

[21] Appl. No.: 09/224,019

[22] Filed: Dec. 31, 1998

Related U.S. Application Data

[62] Division of application No. 08/962,226, Oct. 31, 1997.

[51] Int. Cl.[7] ..... B23P 19/04

[52] U.S. Cl. ..... 29/566.1; 83/909; 140/92.2

[58] Field of Search ..... 29/564.3, 426.4, 29/33 R, 566.1, 566; 242/470; 83/909, 155, 155.1; 140/92.2

[56] References Cited

U.S. PATENT DOCUMENTS

| | | | |
|---|---|---|---|
| 4,205,419 | 6/1980 | Aoshima | 29/56.5 |
| 4,261,395 | 4/1981 | Gronau | 83/909 X |
| 4,437,223 | 3/1984 | Petros | 29/564.3 |
| 4,783,892 | 11/1988 | Hergeth | 29/426.4 |
| 4,831,713 | 5/1989 | Hodén et al. | 29/564.3 |
| 4,835,836 | 6/1989 | Uitert | 29/564.3 |
| 4,841,619 | 6/1989 | Thériault | 29/426.3 |
| 4,955,217 | 9/1990 | Guggenberger et al. | 140/92.2 X |
| 5,105,527 | 4/1992 | Miyata | 29/564.3 |
| 5,131,135 | 7/1992 | Gronau | 29/564.3 |
| 5,163,216 | 11/1992 | Ercums et al. | 29/564.3 |
| 5,199,841 | 4/1993 | Von Gehlen | 414/412 |
| 5,216,797 | 6/1993 | Hawley et al. | 83/155 |
| 5,375,316 | 12/1994 | Carlson et al. | 29/564.3 |
| 5,400,493 | 3/1995 | Hall | 29/426.4 |

FOREIGN PATENT DOCUMENTS

| | | |
|---|---|---|
| 0251414 | 1/1988 | European Pat. Off. . |
| 0281942 | 9/1988 | European Pat. Off. . |
| WO 9213768 | 8/1992 | WIPO . |
| WO 9317916 | 9/1993 | WIPO . |

*Primary Examiner*—William Briggs
*Attorney, Agent, or Firm*—Seed Intellectual Property Law Group PLLC

[57] ABSTRACT

An apparatus for severing and removing wires surrounding a bale of pulp are disclosed, as well as a unique severing and coiling head. A bale of pulp is loaded onto a turn conveyor which transports the bale from where it was loaded to the operating position, where a containment disk is lowered onto the top of the bale to restrain the wires wrapped around the bale during severing. A control arm moves a severing head until the head is in contact with the lateral surface of the bale, and keeps it there during the severing and removal process. The turn conveyor rotates the bale through 360 degrees about its vertical axis, thus drawing the severing head across each of the four lateral faces of the bale. In the first 90 degree increment of the bale's rotation, the teeth of a rotating severing blade engage the wires on the first lateral face of the bale and sever them. In the next 90 degree increment of the bale's rotation, the severing blade engages the wires on the second lateral face of the bale and severs them. The next 90 degree increment moves the severing blade across the third lateral face, which is directly opposed to the first lateral face, where the blade encounters the wires it already severed along the first face. The severing blade's teeth engage the wires, pull them free from the bale, and coil them around a spool that is coaxial with the severing blade and attached thereto.

5 Claims, 5 Drawing Sheets

ROTATABLE DEWIRING APPARATUS

CROSS-REFERENCE TO RELATED APPLICATION

This application is a divisional of pending U.S. patent application Ser. No. 08/962,226 filed Oct. 31, 1997.

TECHNICAL FIELD

This invention pertains to an apparatus and a method for cutting or breaking through wires tightly wrapped around a bale of market pulp and removing the wires.

BACKGROUND OF THE INVENTION

In general, wires are removed from bales of pulp by holding the bale in a fixed position and rotating it about an axis while a severing and removing device is held against, and thus drawn across, the bale's surface. As it traverses the surface of the bale, the severing and removing device engages the wires, severs them, and removes them.

SUMMARY OF THE INVENTION

The invention basically pertains to an apparatus and method for removing wire wrapped around a bale of market pulp. The severing and coiling head used by the apparatus to remove wires is also a unique invention. Basically, the invention includes a means for supporting and rotating the bale about an axis through its center, a means for severing the wire at one rotational position of the bale, and a means for pulling the severed wire off the bale at a second rotational position of the bale.

In the preferred embodiment, the apparatus has a turn conveyor which transports the bale to its operating position, rotates the bale through 360 degrees, and then transports the bale away from its operating position. Adjacent to the turn conveyor is a frame which supports a first arm having on its end a containment disc which is lowered onto the top of the bale. The downward force applied by the containment disc is great enough to hold the wires on the bale as they are being severed but small enough to allow the wires to be pulled off the bale after severing. The frame also supports a second arm having a severing head on its end. The second arm is rotated so as to bring the severing head into contact with the surface of the bale as the bale rotates. During rotation of the bale, the severing head comes into contact with wires at a first rotational location and severs them. At a second rotational location, the severing head and a coiling head come into contact with the back side of the wires that had been previously severed, pulling them away from the bale and coiling them around a spool. When the bale has gone through a complete rotation and all the wires have been removed, the first arm lifts the containment disk off the bale, the second arm draws the severing head away from the bale, the severing head deposits the coil of wire in a wire collecting receptacle, and the bale is transported away.

The method invention is basically rotating a bale 360° at a single position to expose the wires or straps to a severing device at a severing and removing location. The bale is moved through one increment of rotation to expose wire or wires around first opposite sides of the bale where the wires are severed, next the bale is rotated through a second increment of rotation to expose the next wire or wires on the removing opposite sides of the bale, where these wires are severed, then the bale is rotated through a third increment of rotation to expose the previously cut wires to the severing and removing location where the severed wires are removed, and finally rotating the bale through a fourth increment of rotation to expose the second set of severed wires to the severing and removing location where the remaining wires are removed.

As is readily apparent, the apparatus and method have several advantages. Among these are that the apparatus is capable of dewiring all types of market pulp bales, including wrapped or unwrapped bales, dry sheet bales, flash dried bales, and wet lap bales. The apparatus also has the advantage of reducing the cycle time for processing of a bale, and it is also easier to build and maintain than previously available machines.

DETAILED DESCRIPTION OF THE INVENTION

Figure 5:
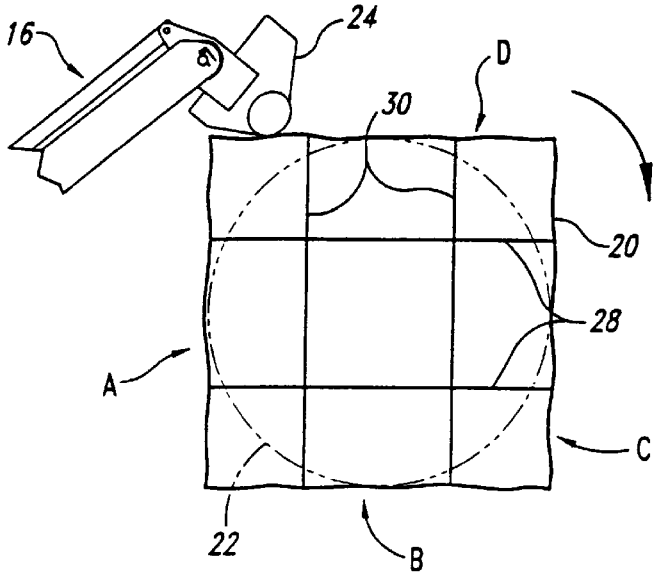
FIGS. 5–9 are schematics showing the typical arrangement of wires on the bale and illustrating the steps in the method by which the wires are severed and removed from the bale by the severing head.

A typical tying arrangement for a bale of pulp is shown in FIG. 5. As is well known, the bale 20 is generally tied with four wires: two wires 28 wrapped vertically around the bale in one direction, and two other wires 30 wrapped vertically around the bale in another direction. With this arrangement, the bale has two wires running vertically along each lateral face of the bale and four wires intersecting each other along the top and bottom faces of the bale. Note that, although the preceding arrangement of wires on the bale is typical, the apparatus is capable of processing a bale with one wire or several wires wrapped around it.

Figure 1:
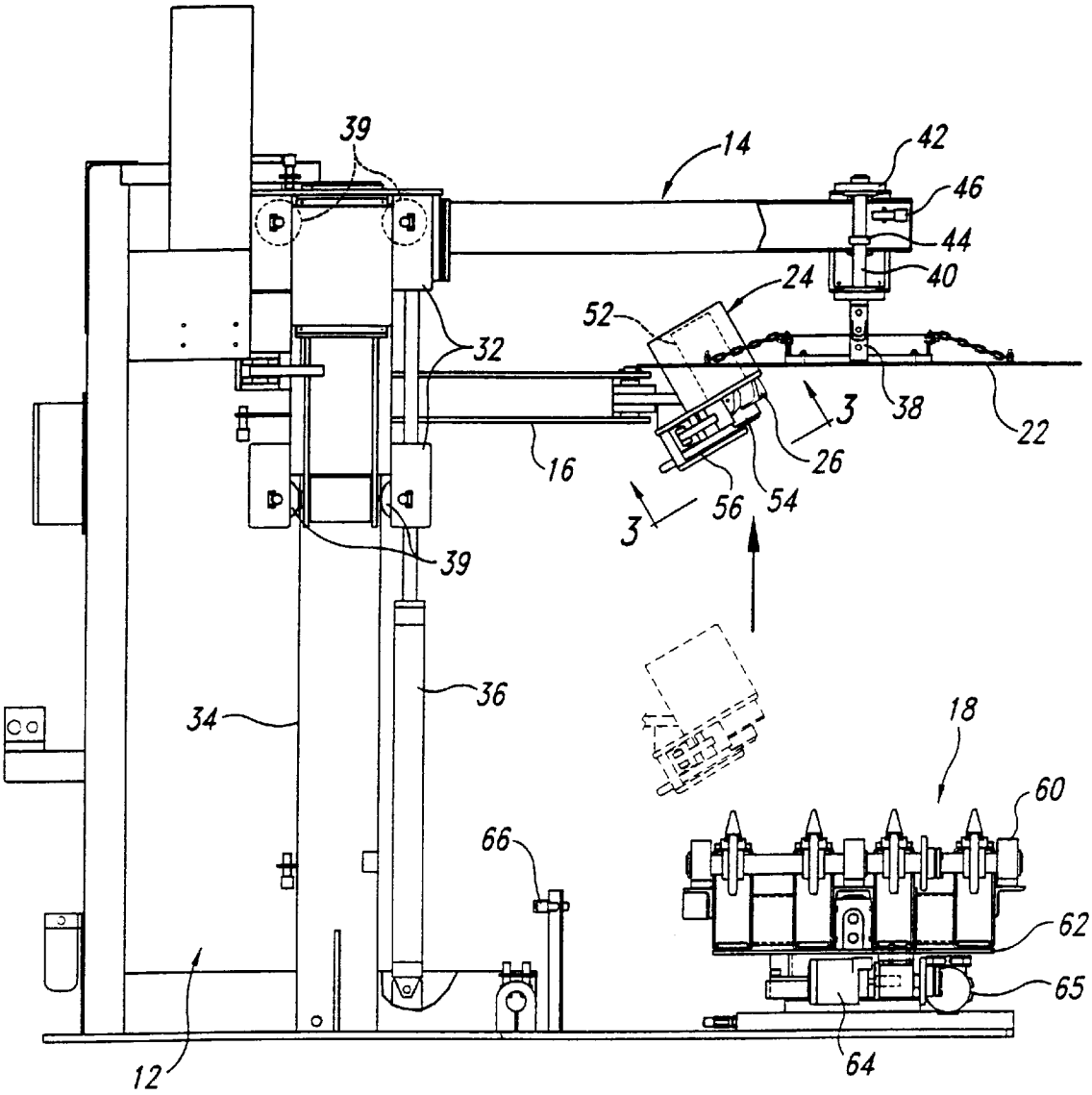
FIG. 1 is a side elevation of the apparatus.

The overall structure and operation of the apparatus is best shown in FIG. 1. The dewiring apparatus consists of a frame 12, support arm 14, and a control arm 16. The support arm 14 is connected at one end to a carriage 32 and at its opposite end to a containment disc 22. The control arm 16 is connected to the carriage 32 at one end and to a severing head 24 at the other end. The carriage 32 is slidably connected to vertical member 34 by guide rollers 39, and the vertical member is firmly attached to frame 12. Located adjacent to the frame is a turn conveyor 18 which rotates about a vertical axis and supports the bale 20.

When the machine is in operation, the bale 20 is placed upon the turn conveyor 18, which transports the bale to a location directly below the containment disc 22. The support arm 14 lowers the containment disc onto the top of the bale 20 in order to hold the wires on the bale during the severing process. After the containment disc 22 is lowered onto of the bale 20, the control arm 16 swings away from the frame 12, bringing the coiling head 24 into engagement with the lateral surface of bale 20. The turn conveyor 18 begins to rotate the bale 20 and the teeth of severing blade 26 (FIG. 3), which turns at a higher angular velocity than the conveyor, come into contact with wires wrapped around the bale, engage them, and sever them. The term "sever" is here used to mean either "breaking" the wire or "cutting." As the bale continues to rotate, wires that had been previously severed by the severing blade again come into contact with the severing blade; the severing blade engages these previously cut wires, pulls them free from the bale, and coils the wires around a spool 54. With continuing rotation of the bale, the remaining severed wires on the bale come into contact with the severing blade and also are removed from the bale and coiled. When all the wires have been removed from the bale, control arm 16 swings away from the bale to a discharge position where the coils of wire are ejected from the spool into a receptacle, and then returns to a home position where the control arm sits until the next bale is loaded into the apparatus and is ready to be processed.

Figure 2:
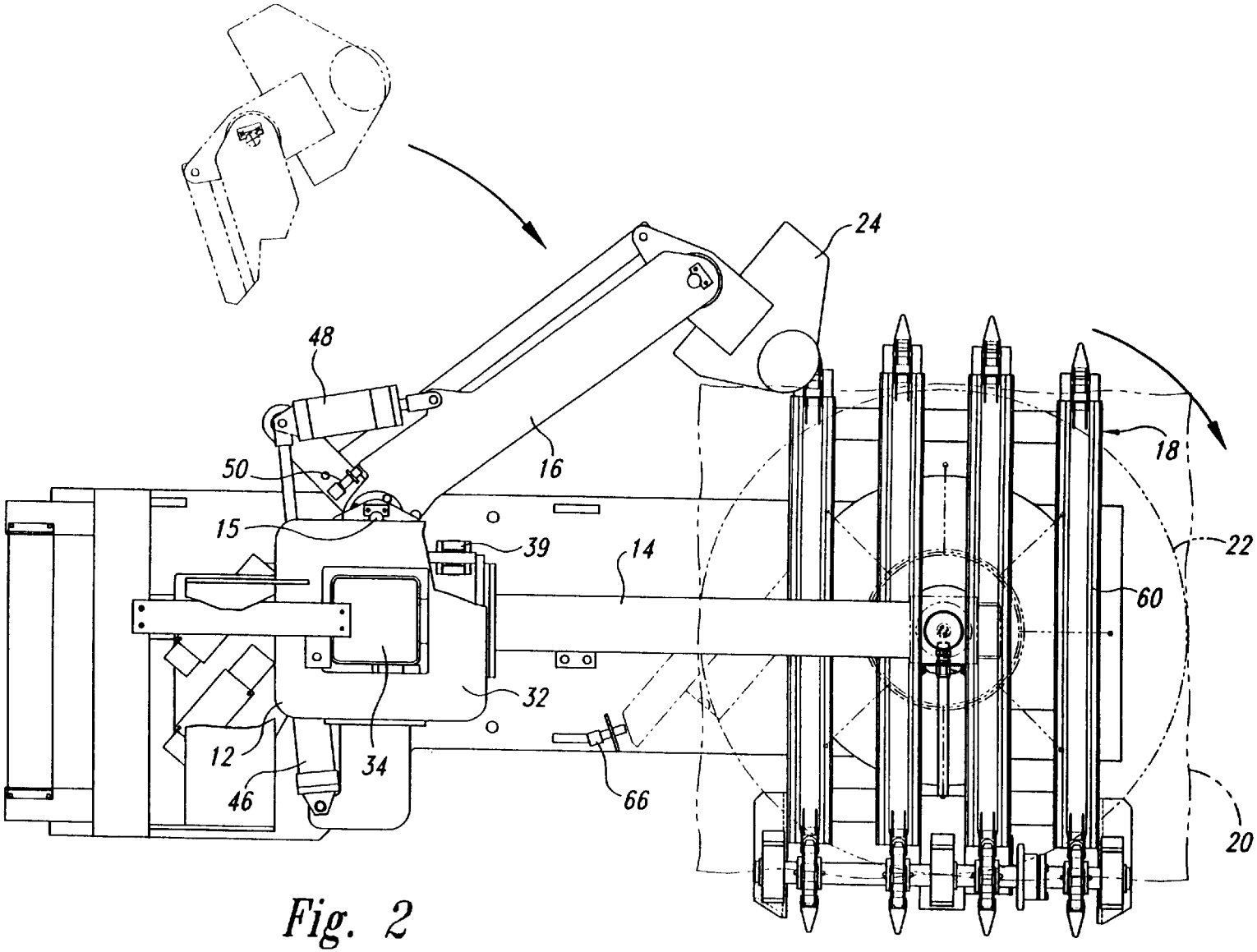
FIG. 2 is a top view of the apparatus.

As best shown in FIGS. 1 and 2, the support arm 14 is mounted to a carriage 32 slidably attached to a vertical member 34 by guide rollers 39. The vertical member 34 is a hollow tube with square cross section attached to the frame 12. The carriage is a single unit into which the vertical member is inserted. A series of flanges on the carriage support eight guide rollers 39 that guide the carriage along the vertical member, with two rollers traveling along each side of the vertical member 34. A hydraulic cylinder 36 connects the carriage to the frame and drives the vertical motion of the carriage. At the opposite end of the support arm from the carriage is mounted the containment disc 22.

FIG. 1 shows the details of the connection of the containment disc 22 to the support arm 14. The containment disc is attached via a universal joint 38 to a vertical shaft 40 which is slidably attached to the support arm. The vertical shaft is held in place by a retaining ring 42 and is capable of a limited amount of vertical motion, its downward motion being limited by the retaining ring and its upward motion being limited by set collar 44.

When the apparatus is in operation, hydraulic cylinder 36 lowers the carriage, thus lowering the containment disc 22 onto the bale 20. When the containment disc comes in contact with the top of the bale, the vertical shaft 40 is pushed upward relative to the support arm until the set collar 44 trips a bale position switch 46, signaling to the machine that the containment disc is in contact with the top of the bale and that the downward motion of the support arm should cease. The universal joint 38 allows the containment disc to adjust to any irregularities in the top of the bale; for example, if the bale is not perfectly square so that the top of the bale is not perfectly horizontal, then the universal joint 38 allows the containment disc to be positioned such that it is still flush with the top of the bale. The downward force applied to the top of the bale by the containment disc is great enough to hold the wires on the bale as they are severed and the tension therein is released, but small enough to allow the wires to slide between the bale and the containment disc so that they may be pulled off the bale after severing.

The structure and operation of the control arm 16 are best illustrated in FIGS. 1 and 2. The control arm is a four bar parallelogram linkage that is pinned to the carriage 32 in such a manner that the control arm moves vertically with the carriage and rotates around the pin 15. Because the support arm 14 is also attached to the carriage, a constant separation is maintained between the support and control arms. The rotation of the control arm 16 about the pin 15 is driven by pneumatic cylinder 46, which is attached to the carriage at one end and to the control arm at its opposite end. The articulation of the four bar linkage to articulate the severing head 24 relative to the control arm is by pneumatic cylinder 48 attached to two links of the four bar linkage. Severing head 24 is attached to the control arm on the opposite end from where the arm is attached to the carriage.

During operation of the apparatus, the pneumatic cylinder 48 rotates the control arm until the severing head 24 is in contact with the surface of the bale and keeps the severing head tracking around the bale in contact with the surface of the bale as the bale rotates. As the control arm rotates about the pin, the pneumatic cylinder 48 articulates the four bar mechanism so as to keep the severing head squarely against the surface of the bale, thus optimizing the operation of the severing head. When the bale has rotated through 360 degrees and all the wires have been removed therefrom, the pneumatic cylinders 46 and 48 rotate the control arm away from the bale to a fully retracted position where the coiled wire is ejected from the coiling head. The pneumatic cylinder 46 then rotates the control arm back towards the bale until the control arm trips an arm home switch 50, indicating to the machine that the arm is in its home position and ready to process a new bale.

Figure 3:
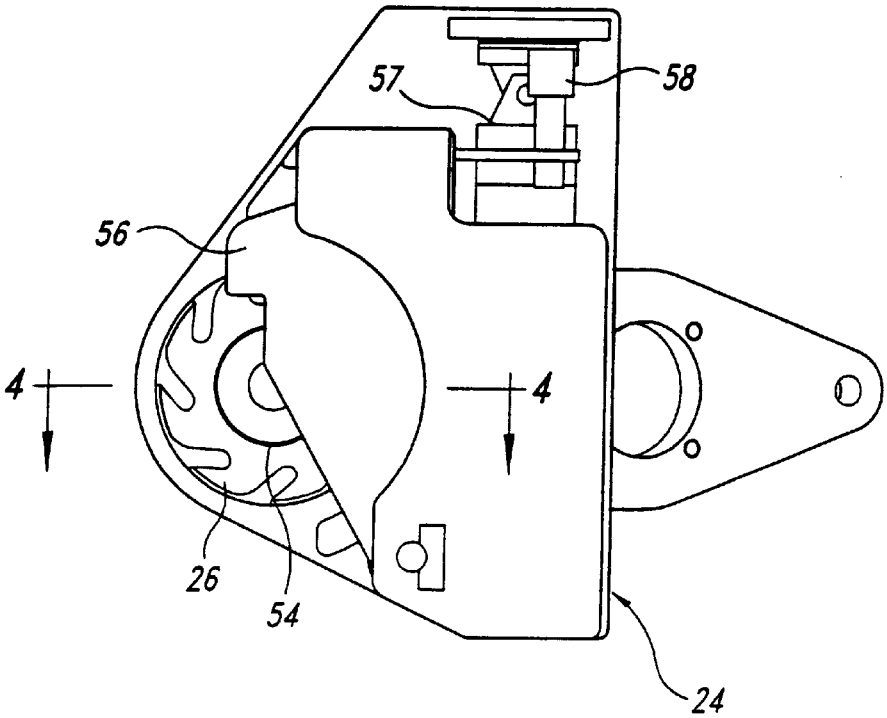
FIG. 3 is a bottom view of the severing head.
Figure 4:
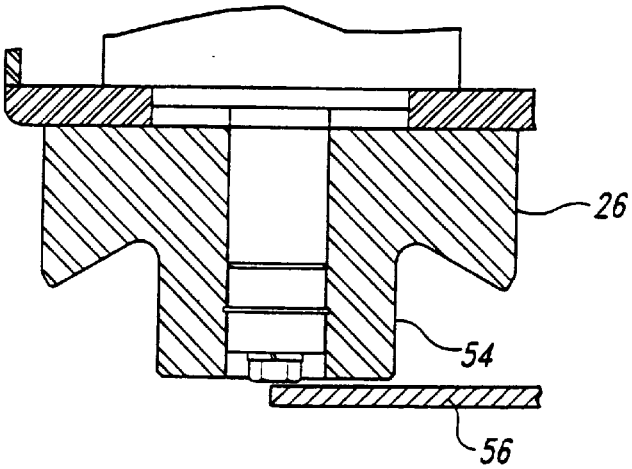
FIG. 4 is a section taken along the lines 4—4 of FIG. 3 but shown inverted to better show its position during operation of the apparatus.

FIGS. 3 and 4 illustrate the severing head 24. The severing head has a hydraulic motor 52 (FIG. 1) which connects to, and rotates, a circular severing blade 26. A cylindrical spool 54 having a smaller diameter than the severing blade is mounted concentrically with the severing blade, and a retention plate 56 extends across the bottom of the spool to keep the coil of wire wrapped around the spool from sliding off. A particular embodiment where the coiling blade 26 and the spool 54 are integrally formed into one piece is shown in FIG. 4. Furthermore, the severing blade preferably has blunt teeth to break rather than cut the wires; however, the invention also contemplates cutting the wires and using an independent separate wire removing apparatus not integral with the severing head.

During operation of the severing head, hydraulic motor 52 turns the severing blade 26 at an angular velocity that is greater than the angular velocity of the turn conveyor; typically, the angular velocity of the blade is about 80 rpm. When the blade comes in contact with a wire that has not yet been severed, the teeth on the blade engage the wire and sever it. The wire remains on the bale after severing due to the containment disk, and as the bale continues to rotate and the head encounters a wire that has already been severed, the teeth on the blade once again engage the wire, but this time the blade pulls the wire off the bale and coils it around the spool 54. The wires are kept on the spool by retention plate 56.

Figure 6:
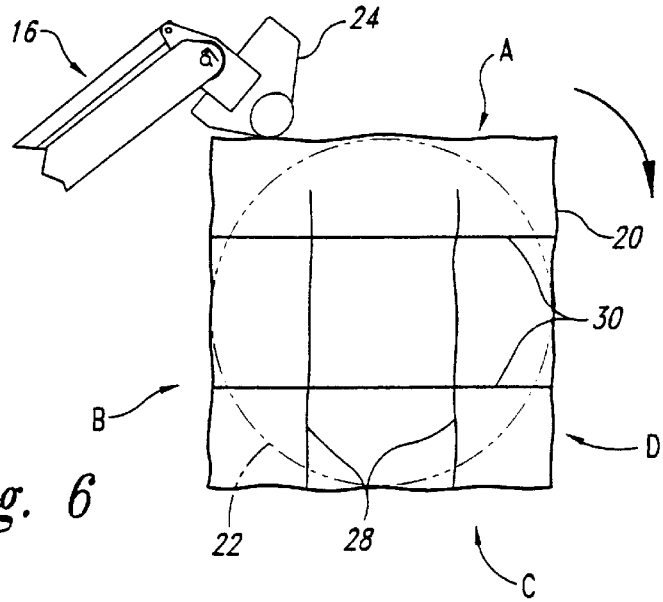
Figure 7:
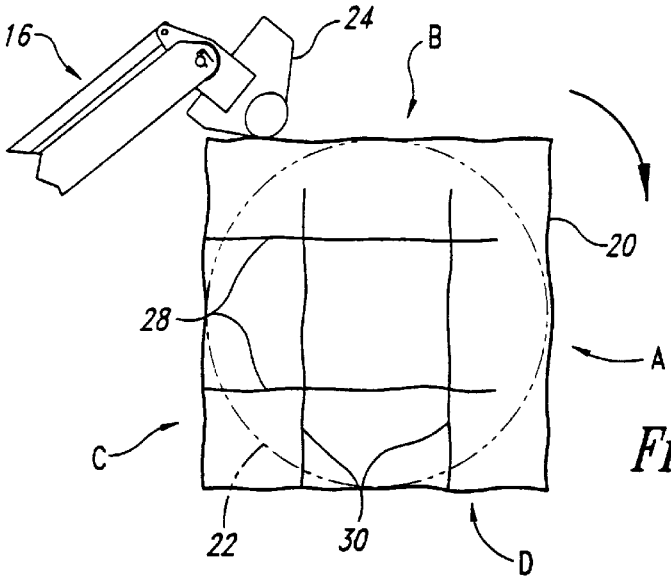
Figure 8:
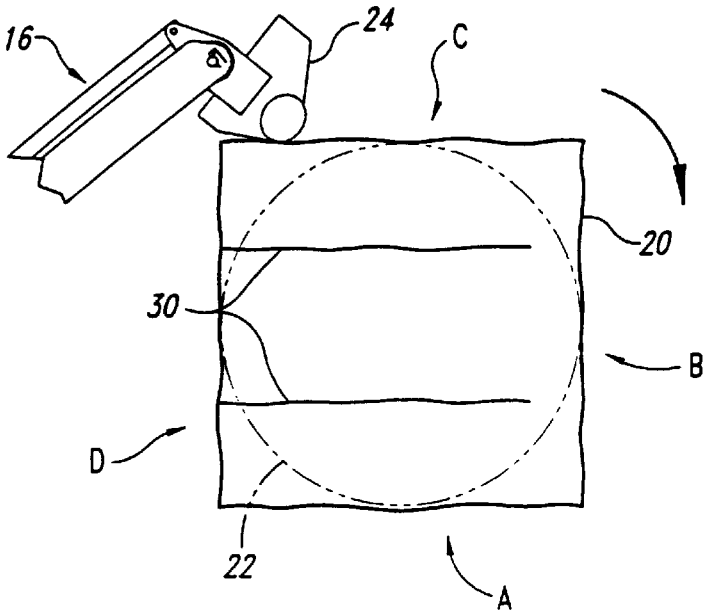
Figure 9:
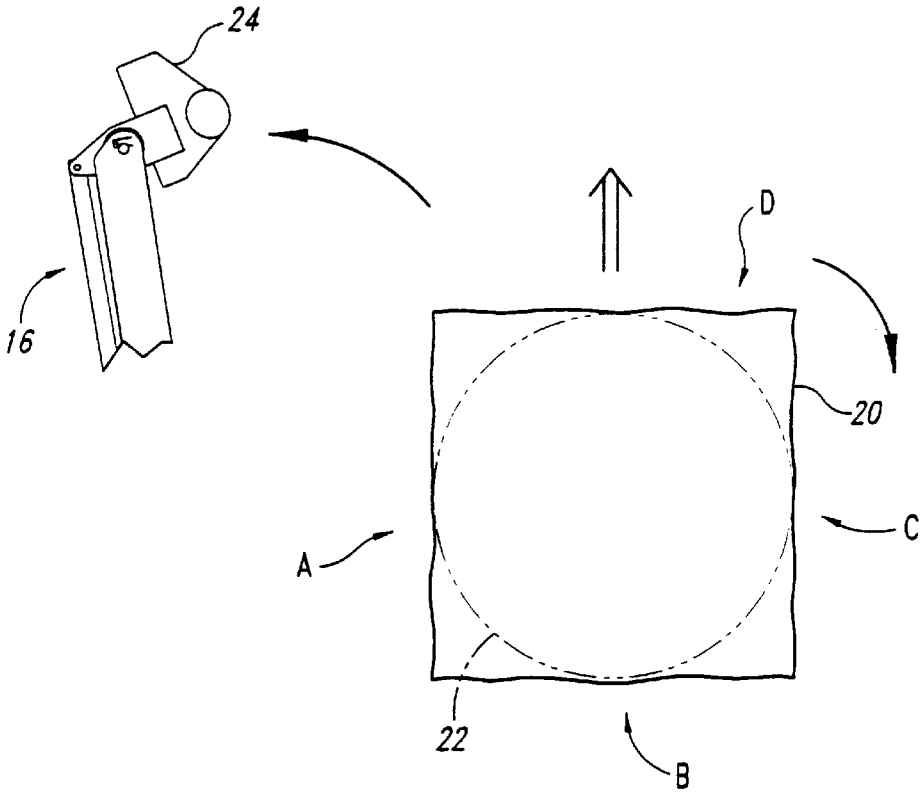

FIGS. 5–9 best illustrate the sequence of events involved in removing the wires from the bale and best show the method of the invention. The figures show the severing head 24 being held in its operational position against the surface of the bale by the control arm 16, and also show the containment disc 22 in its lowered position on the top of the bale. The cycle starts with FIG. 5, where the severing head has just been brought into contact with the surface of the bale. As the bale turns through the first 90 degrees of rotation, as shown in FIG. 6, the head follows the bale's surface along face A, encounters the first set of wires 28, and severs them as described above. As the bale continues to rotate through its second 90 degree turn, the coiling head moves along face B of the bale, as shown in FIG. 7, where it encounters the second set of wires 30 and also severs them. A third 90 degree rotation of the bale, shown in FIG. 8, moves the head along face C of the bale, where it again encounters the first set of wires 28 which were severed along face A during the first 90 degree rotation. Because the wires are already severed, the blade engages the wires 28, pulls them off the bale, and coils them around the spool 54 as described above. After the wires 28 have been pulled away from the bale at face C, the bale makes its last 90 degree rotation as shown in FIG. 9, and the coiling head moves along face D where it encounters the remaining set of severed wires 30 and pulls them away from the bale in the same manner as it did with wires 28 along face C. FIG. 9 shows the bale at the end of its cycle where all wires have been removed and is being transported away on the turn conveyor.

When the cycle is completed as described above, the control arm moves the severing head from its operating position against the surface of the bale to a discharge position. Upon reaching the discharge position, the retention plate 56 is rotated away from its position at the end of the spool by hydraulic cylinder 57, until it trips the table open switch 58, indicating its fully retracted position. The severing blade and spool are rotated in reverse at an angular velocity of 120 rpm. The retraction of the retention plate leaves the end of the spool clear so that the wires, which were removed from the bale and are now coiled around the spool, can slide off the spool and into a receptacle. Once the coils of wire are discharged, the retention plate returns to its closed position over the end of the spool and the control arm is moved back towards the bale until it trips the arm home switch 50, thus indicating to the machine that it is ready to receive and process a new bale.

FIGS. 1 and 2 best illustrate the operation of turn conveyor 18. The turn conveyor has a conveyor belt assembly 60 mounted atop a turntable 62, the turn conveyor being driven by hydraulic motor 64. When in operation, the turn conveyor starts out in a home position where it is in contact with the turn conveyor home position switch 66. When a bale is loaded on the turn conveyor, the conveyor belt assembly transports the bale to a position directly beneath the containment disc. The containment disc is lowered upon the top of the bale and the turn conveyor proceeds to turn the bale through 360 degrees about its vertical axis while the severing head removes the wires from the bale as described above. When the turn conveyor has gone through a full rotation, it again comes in contact with the turn conveyor home position switch 66, signaling to the machine that the cycle is finished, so that the control arm 16 should be retracted, the containment disk 22 should be lifted, and the bale should be transported off the turn conveyor. After the retraction of the control arm and the lifting of the containment disk, the hydraulic motor 65 begins to drive the conveyor belt again and the bale is transported off the conveyor belt at the opposite end from where it was loaded onto the conveyor belt.

While the preferred embodiments of the invention have been illustrated and described, it should be understood that variations will be apparent to one of ordinary skill in the art. Accordingly, the invention is not to be limited to the specific embodiments or method steps illustrated in the drawings or described in the specification.

We claim:

1. An apparatus for severing and coiling wire wrapped around a bale comprising:

a rotating severing blade comprising a plurality of spaced severing teeth wherein the severing teeth engage the wire and sever it either by cutting or by breaking, and also engage severed wire and pull it off the bale;

a spool attached to the severing blade and coaxial therewith about which wires are coiled by the severing blade when removed from the bale; and a retention plate positioned across the end of the spool to prevent the coiled wires from sliding off the spool.

2. The apparatus of claim 1 including a motor drive rotating the blade in first and second opposite direction, wherein the severing blade and spool rotate in a first direction for severing and removing wires and a second direction reverse to the first direction for ejecting wires from the spool.

3. The apparatus of claim 1, further comprising means for withdrawing the retaining plate from the end of the spool to eject the coiled wire from the spool.

4. The apparatus of claim 1, further comprising a drive shaft with a motor attached to one end, wherein the severing blade and spool are attached to the opposite end of the drive shaft.

5. The apparatus of claim 1, further comprising a drive shaft with a motor attached to one end and means for withdrawing the retaining plate from the end of the spool, wherein the severing blade and spool are coaxial and are attached to the drive shaft, and including control means wherein the severing blade and spool rotate in a first direction for severing and removing wires and a second direction for ejecting wires from the spool.

* * * * *